US009186592B2

(12) United States Patent
Zwiers et al.

(10) Patent No.: US 9,186,592 B2
(45) Date of Patent: Nov. 17, 2015

(54) TOY WITH INTERCHANGEABLE HAIR COMPONENTS

(71) Applicant: Funosophy, Inc., Long Beach, CA (US)

(72) Inventors: Nancy A. Zwiers, Long Beach, CA (US); Margaret E. Wray, Murrieta, CA (US)

(73) Assignee: Funosphy, Inc., Long Beach, CA (US)

( * ) Notice: Subject to any disclaimer, the term of this patent is extended or adjusted under 35 U.S.C. 154(b) by 0 days.

(21) Appl. No.: 14/624,343

(22) Filed: Feb. 17, 2015

(65) Prior Publication Data

US 2015/0224412 A1 Aug. 13, 2015

Related U.S. Application Data

(63) Continuation of application No. 14/099,501, filed on Dec. 6, 2013, now abandoned, which is a continuation of application No. 12/857,069, filed on Aug. 16, 2010, now Pat. No. 8,602,835.

(51) Int. Cl.
*A63H 3/44* (2006.01)

(52) U.S. Cl.
CPC ..... *A63H 3/44* (2013.01)

(58) Field of Classification Search
USPC ..... 446/319, 321, 394
See application file for complete search history.

(56) References Cited

U.S. PATENT DOCUMENTS

| | | | | | |
|---|---|---|---|---|---|
| 3,156,999 | A | * | 11/1964 | Dean et al. | 446/319 |
| 3,205,547 | A | * | 9/1965 | Riekse | 24/462 |
| 4,070,790 | A | * | 1/1978 | Strongin et al. | 446/394 |
| 4,626,225 | A | * | 12/1986 | Katzman et al. | 446/394 |
| 4,698,880 | A | * | 10/1987 | Hamm | 24/72.5 |
| 4,874,676 | A | * | 10/1989 | Miller et al. | 428/542.2 |
| 5,041,050 | A | * | 8/1991 | Ritchey et al. | 446/394 |
| 5,149,288 | A | * | 9/1992 | Kelley | 446/319 |
| 5,299,968 | A | * | 4/1994 | Bennett | 446/394 |
| 6,139,397 | A | * | 10/2000 | Blau et al. | 446/319 |
| 6,176,756 | B1 | * | 1/2001 | Panec | 446/99 |
| 6,190,229 | B1 | * | 2/2001 | Nadel et al. | 446/219 |
| 7,165,296 | B2 | * | 1/2007 | Coleman | 24/462 |
| 2007/0238388 | A1 | * | 10/2007 | Morehead | 446/394 |

FOREIGN PATENT DOCUMENTS

| | | |
|---|---|---|
| FR | 2 411 618 A1 | 7/1979 |
| FR | 2 559 073 A1 | 8/1985 |

OTHER PUBLICATIONS

PCT International Search Report and Written Opinion for PCT/US2011/047867 dated Nov. 4, 2011 (12 pages).

Betty Spaghetty Stylin Head's Hippy Chic: http://www.amazon.com/Betty-Spaghetty-Stylin-Heads-Hippy/dp/B0011FSWLW/ref=sr_1_11?ie=UTF8&s=toys-and-games&qid=1279734955&sr=1-11, 5 pages.

* cited by examiner

*Primary Examiner* — Melba Bumgarner
*Assistant Examiner* — Joseph B Baldori
(74) *Attorney, Agent, or Firm* — Knobbe Martens Olson and Bear LLP

(57) ABSTRACT

A toy in the form of a horse with removable and interchangeable hair components. The mane hair component can be easily slid into and out of a channel defined along the length of the neck of the horse toy. A tail component is secured within a complementary receptacle in the body of the horse.

15 Claims, 4 Drawing Sheets

TOY WITH INTERCHANGEABLE HAIR COMPONENTS

INCORPORATION BY REFERENCE TO ANY PRIORITY APPLICATIONS

Any and all applications for which a foreign or domestic priority claim is identified in the Application Data Sheet as filed with the present application are hereby incorporated by reference and made a part of the present disclosure.

TECHNICAL FIELD

Embodiments of the present invention relate to a toy with interchangeable parts. Specifically, the embodiments of the invention relate to a toy in the form of a horse with removable and interchangeable mane and tail pieces.

BACKGROUND

There are many toys designed for brushing, combing and styling play activities. Typically these toys have hair pieces that are mounted at one end within the housing or body of the toy, such as a doll or horse. These hair pieces are fixed at one end within the housing. This fixed mounting would require a disassembly of the toy in order for the hair to be removed or replaced, which is outside the design of these toys and their intended use as part of the play activities that are appropriate for the target age group for the toy.

Toy horses in particular tend to have both a mane and tail that are either molded of plastic that is unitary with the overall molding of the horse or artificial or real hair that is mounted within the body of the horse toy. Some horse toys have a feature of allowing a mane or tail to "grow" by enabling the child to pull on the hair and unspool additional hair from an internal storage within the housing. However, in these toys once the hair is entirely unspooled the hair piece remains firmly mounted within the body of the horse. Removing the hair entirely would require the hair piece to either be forcefully pulled from the mounting mechanism or for the body of the horse to be opened such that the mounting mechanism can be removed. However, these bodies are designed to prevent the toy from easily being opened, because granting access to the internal components, which often include small parts, would not be appropriate for the target demographic for the toy. Further, opening the body of the toy would require damaging the mechanism holding the parts of the toy together or would require specialized tools.

BRIEF DESCRIPTION OF THE DRAWINGS

The embodiments of the invention are illustrated by way of example and not by way of limitation in the figures of the accompanying drawings in which like references indicate similar elements. It should be noted that references to "an" or "one" embodiment of the invention in this disclosure are not necessarily to the same embodiment, and they mean at least one.

DETAILED DESCRIPTION

Figure 1:
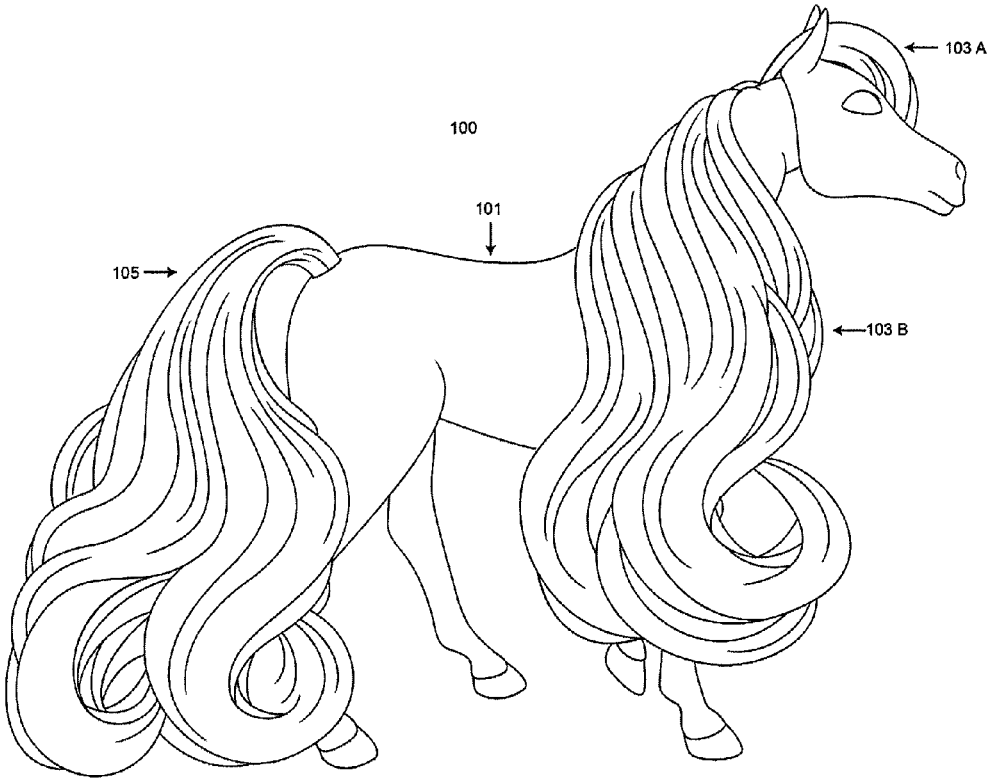
FIG. 1 is a drawing of one embodiment of a horse toy with an interchangeable mane and tail.

FIG. 1 is a diagram of one embodiment of a toy with interchangeable hair components. In one embodiment, the toy is in the form of a toy horse 100. The embodiments described herein relate to the example of a horse. However, one of ordinary skill in the art would understand that the principles and structures described herein would also apply to other types of dolls and toys having a design for use in hair combing and braiding play.

The toy 100 includes a housing 101 that defines the shape of the body of the toy 100. The housing 101 can be formed of any material including soft and hard plastics, natural or artificial resins or similar materials and any combination thereof. The housing 101 can define a hollow interior space, a non-hollow construction or any combination thereof. The shape, color and size of the housing 101 can be varied to represent different types or breeds of horses, different stances or different types of animals entirely.

The housing 101 can define a receptacle and a channel into which the hair components for the tail 105 and the mane 103A, 103B are disposed, respectively. The tail receptacle is positioned appropriately at the rear of the housing 101 such that when a tail piece 105 is inserted into the receptacle, the horse has an overall appearance of having a tail such that hair flows out of the receptacle and lays or hangs in a manner similar to an actual horses' tail. The channel holding the mane 103A, 103B is positioned along the length of the neck, specifically the back of the neck of the horse or in a similar position such that the hair 103A, 103B protruding from the hair component through an opening in the channel is positioned to fall or lay in a manner similar to that of a real horse. The tail 105 and mane 103A, 103B can be formed from any type of synthetic or natural fiber including polymer threads and natural hair. The tail 105 and mane 103A, 103B can be any size, length or density to achieve an overall desired aesthetic look for the horse toy 100.

In one embodiment, the horse housing 101 can be four to eight inches tall (e.g., 6.25 inches tall from hoof to ear). The horse housing 101 can be four to ten inches long (e.g, 5.4 inches long from nose to tail). The horse housing 101 can have a width from one inch to six inches. One skilled in the art would understand that these measurements are provided by way of example and demonstrate ratios and proportions between the different components of the horse toy. The horse toy can have any scale or size while roughly maintaining these proportions (e.g., the horse can have a fashion doll scale of approximately ten inches tall and 9.5 inches long).

Figure 2A:
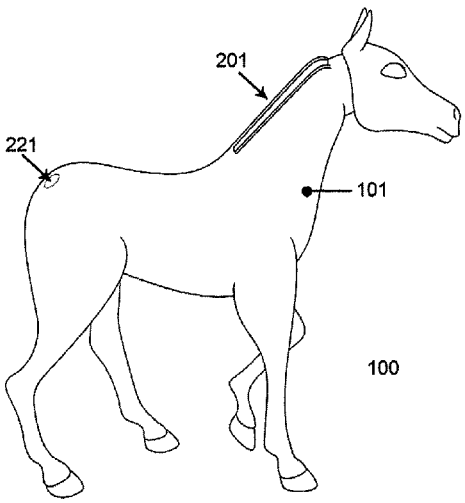
FIG. 2A is a diagram of one embodiment of a horse body.

FIG. 2A is a diagram of one embodiment of a body of the toy 100. The housing 101 is shown here without the tail and mane accessories. The housing 101 has visible openings for the receptacle 221 and channel 201 respectively. The receptacle opening 221 can have any shape or dimensions. In one embodiment, the openings or apertures are roughly circular in shape with a diameter ranging from three to twenty millimeters. The channel opening 201 through which a mane would protrude runs the length or a portion of the length of the neck of the horse toy 100. The length can range from 0.5 inches to three inches (e.g., 1.25 inches long) dependent on the size and type of the horse toy and mane. The width of the opening 201 can range from 0.01 inches to 0.5 inches leaving sufficient space for the hair to protrude through the opening 201 along the length of the neck.

Figure 2B:
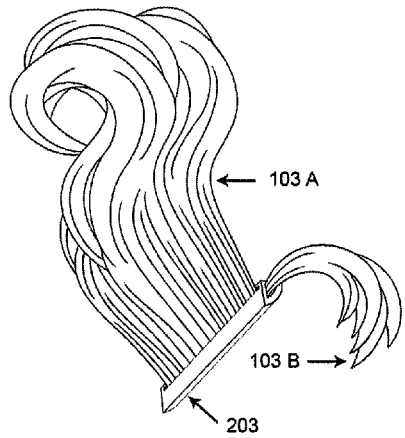
FIG. 2B is a diagram of one embodiment of a removable mane.

FIG. 2B is a diagram of one example embodiment of a mane hair component. The mane hair component 203 is easily removable from the toy horse and interchangeable with other mane hair components by simply sliding the mane hair component 203 in and out of the channel defined in the body. The base of the hair component 203 can have any shape, size or dimension that fits within the channel of the horse toy. In one embodiment, the base of the mane hair component 203 has roughly a triangular or pie-shaped cross-section with a slit running the length of the mane hair component 203 defining an opening through which the hair of the mane 103A can be disposed. The slit can be defined in one of the side walls of the mane hair component thereby directing the hair and guiding it to fall on one side of the mane hair component 203 and horse toy.

The base can be formed from modeled plastic, resin or similar materials. The base can have a length from 0.5 inches to three inches (e.g., 1.25 inches) dependent on size of the toy and mane. The opening or slit for the mane can run the length of the base and have a length of 0.25 to three inches. In one example embodiment, the width of the base is 0.35 inches at the widest part of the base. In the example embodiment, the base is 0.2 inches to 0.35 inches high at the apex of the triangle. In another embodiment, at one end of the base another portion of the mane 103B protrudes. The two mane portions 103A, 103B can be formed from the same set of fibers or hair or may be formed from separate sets. A fashion doll scale horse can have a base that is three inches long and 0.75 inches wide.

Each set of hair 103A, 103B is held in the base of the hair component 203 by a form fit, clasp fit, clamp mechanism, adhesive or similar securing mechanism. In one embodiment, the mane 103A, 103B is adhered to an inner surface of the base to secure it to the base.

Figure 2C:
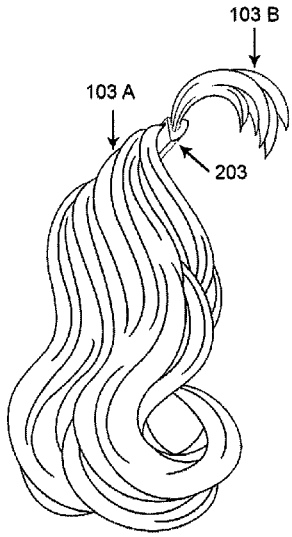
FIG. 2C is a diagram of another embodiment of a removable mane.

FIG. 2C is an alternate hair component that is interchangeable with the first hair component. The second hair component 213 has a base, the same cross-sectional dimensions and roughly the same length and overall dimensions. This hair component 213 also includes the two portions of the mane 113A, 113B that protrude from each of the hair openings of the component 213. The hair or mane 113A, 113B can have different colorations, be formed from different materials, have a different length, have a different style (e.g. curly or wavy hair) or other variations in characteristics such that exchanging the hair component 213 for the other hair component 203, creates a different look or aesthetic for the toy. A set of separate hair components can be interchangeably inserted into the channel of the toy horse, with each having different styles of hair such as braids, curls and other variations in the characteristics of the hair in each hair component 203,213 thereby providing variety in the style and quality of play for the toy. The styles in the mane shown in FIGS. 2A and 2B are provided by way of example. One of ordinary skill in the art would understand that the length, style, color or similar characteristics can be varied to provide any number of alternate play experiences such that a horse can be combined with any number of different hair components to provide a large number of different types of play opportunities.

Figure 2D:
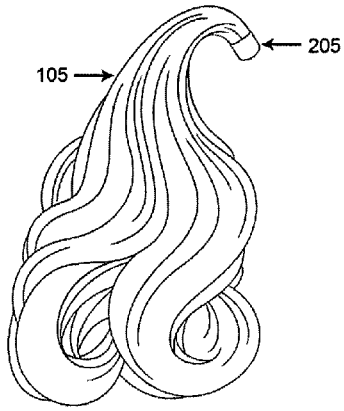
FIG. 2D is a diagram of one embodiment of a removable tail.

FIG. 2D is a diagram of one embodiment of a tail component 205. The tail component 205 includes the tale 105 that can have any length, density, color, styling or similar characteristics. The hair component 205 can have a shape and size that are complimentary to the receptacle within the horses' housing. In other embodiments, the tail component 205 can have inter-locking or inter-compatible parts that engage in a locking mechanism within the horse to secure the tail within the horse during play. Such a locking mechanism may be engaged or disengaged by a button, pressure mechanism, complimentary threading or similar types of inter-locking parts or mechanisms. The tail component 205 can have any shape or size suitable for the aesthetic purposes of the overall toy. In one example embodiment, the tail has a base that is 0.1 inches to 0.5 inches in diameter (e.g., 0.32 inches in diameter) and that is 0.1 inches to 0.75 inches tall (e.g., 0.45 inches tall). A fashion doll scale horse can have a tail base that is 0.55 inches in diameter and 0.75 inches tall.

Figure 3:
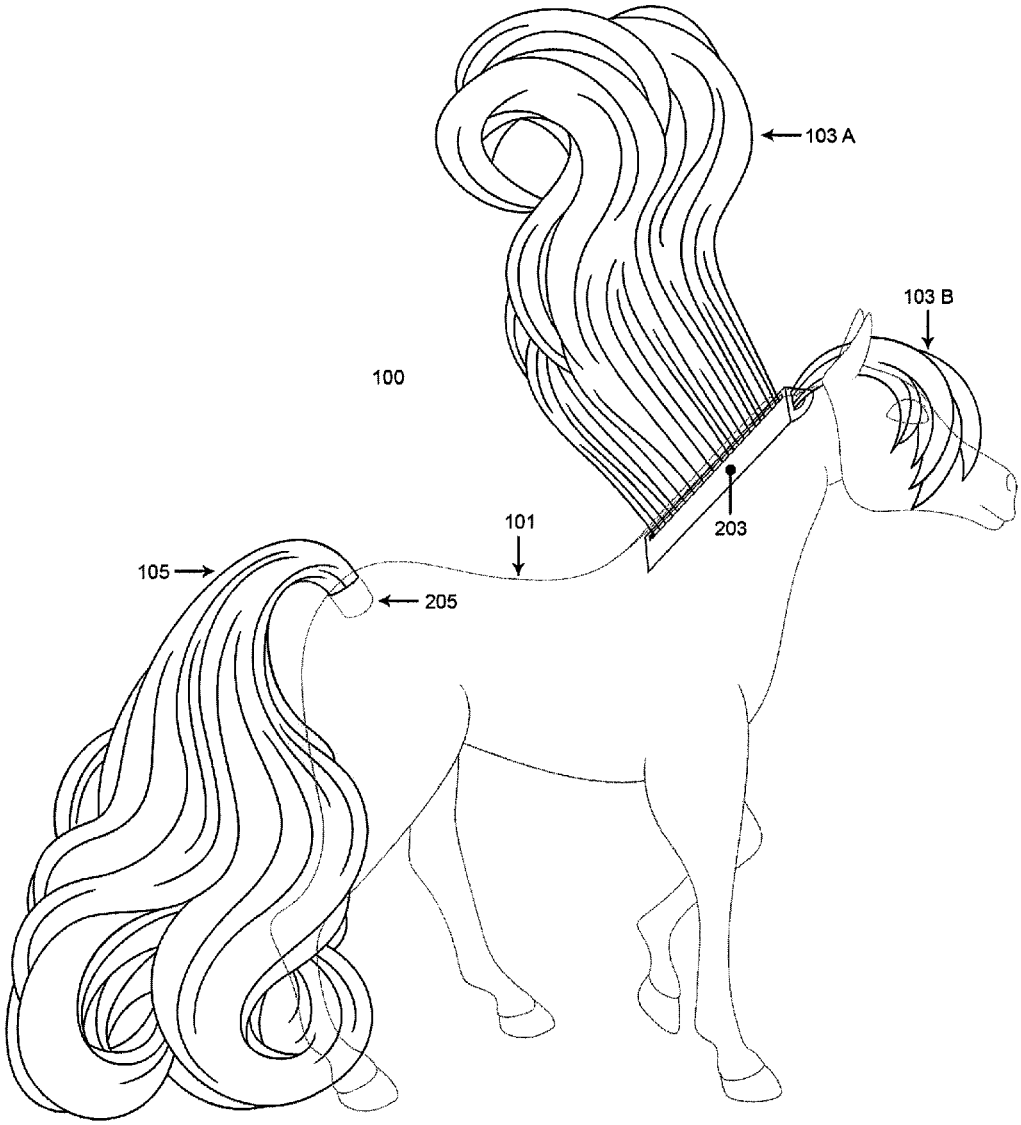
FIG. 3 is a diagram of one embodiment of the body of the horse toy with a cross-sectional view.

FIG. 3 is a diagram of one embodiment of the toy with a cross-sectional view. This view of a cross-section of the toy shows the disposition of the base of the hair component 203 within the channel in the neck of the toy and the relative positioning of the hair 103A, 103B as it extends out from the hair component 203 in relation to the housing of the toy 100. In one embodiment, the hair component 203 has a shape that is complementary to the shape of the receiving channel in the horse hosing 101 to create a snug form fit. The shape of the hair component 203 can prevent the improper insertion or to guide the insertion of the hair component 203 by forcing a specific orientation of the hair component 203. For example, one of the walls of the hair component 203 can be outwardly or convexly curved thereby requiring that it be matched with a complementary wall of the receiving channel.

Similarly, the tail component 205 is shown disposed in the body of the housing of the toy 100 such that the tail 105 protrudes in an appropriate orientation and location from the horse thereby combining with the hair component 203 to provide a simulated mane and tail for the horse toy 100.

Figure 4:
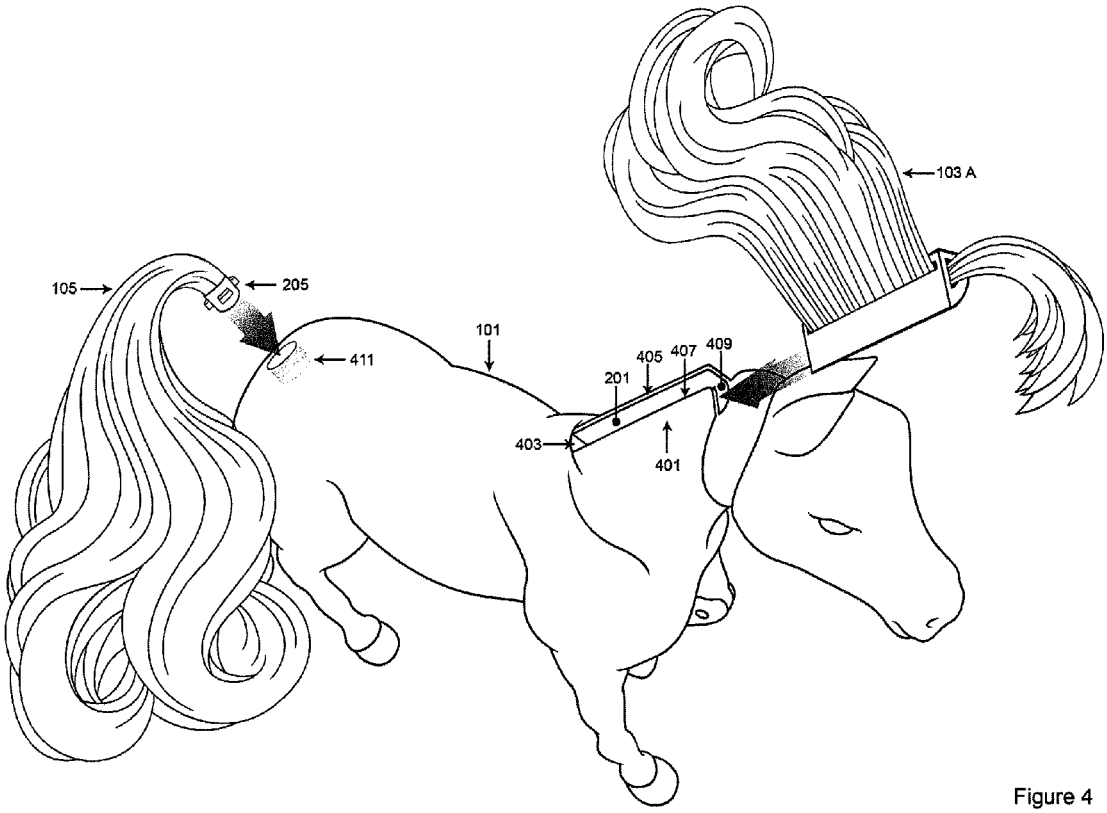
FIG. 4 is a diagram of one embodiment of a horse toy showing a defined channel and receptacle for receiving the interchangeable mane and tails.

FIG. 4 is a diagram of another embodiment of the toy showing the layout of the channel 401 for receiving the interchangeable hair components. In one embodiment, the channel 401 runs the length of the neck or a portion of the length of the neck of the horse toy 100. The channel 401 includes openings 201 and 409, back stop 403 and side walls 405 and 407. The hair component 203 slides into the opening 409 and between the side walls 405, 407 until it rests against the back stop 403.

The hair protruding from the hair component 203 also slides through the opening 201 during the insertion process and lays over one of the side walls 405,407. The hair component 203 may be secured in the channel 401 with a form fit, snap fit, clasp or similar holding mechanism. Further, the nature of the play is that the combing of the hair 103A, 103B and similar forces exerted on the hair 103A, 103B are roughly perpendicular to the central axis and movement of the hair component 203 within the channel 401. Thus, standard play with the toy is unlikely to dislodge the hair component 203 from the channel 401.

The receptacle 411 for the tail component 205 is shown as having a form or shape that includes one example of a locking mechanism that secures the base of the tail component 205 within the housing 101. In the example, the base defines a set of protrusions or knobs that after insertion and a rotation of the tail lock the tail component into the receptacle 411. The receptacle 411 defines a set of opposing protrusions with spaces between them that enable the tail component 205 to be inserted. The locking mechanism and receptacle also provide an orientation for the tail 105. The receptacle 411 can have any complimentary or inter-locking mechanisms for holding and securing the tail component 205 within the receptacle 411. The size and shape of the receptacle 411 compliments the size and shape of the tail component 205. The receptacle 411 can have any shape or size designed to hold or secure the tail component 205.

In the foregoing specification, the invention has been described with references to specific embodiments. It will, however, be evident that various modifications and changes can be made thereto without departing from the broader spirit and scope that is set forth in the appended claims. The specification and drawings are accordingly to be regarded in illustrative rather than a restrictive sense.

The invention claimed is:

1. A toy comprising:

a one-piece integral housing defining a shape of a horse; and a channel defined by the housing and having a length, the channel having a first channel end at one end of the length to receive a first removable mane component and a first opening along a portion of a neck of the shape of the horse through which the mane is disposed, the channel also having a second channel end at the other end of the length;

wherein the first removable mane component includes a base configured to secure the removable mane component within the channel and a mane having a plurality of natural or artificial threads, the base having a first base end and a second base end;

wherein the base includes a longitudinal axis and the first base end and the second base end are aligned along the longitudinal axis and on opposite ends of the base;

wherein the channel includes a second opening at the first channel end through which the first base end of the base of the mane component is inserted and the base is inserted into the channel by sliding the base into the channel in a direction parallel to the longitudinal axis of the base; and wherein the first base end is adjacent the second channel end and the second base end is adjacent the first channel end when the base is completely inserted into the channel.

2. The toy of claim 1, wherein the first channel end defines the second opening and the second opening is a triangular opening through which the base of the first removable mane component is inserted and removed from the channel.

3. The toy of claim 1, further comprising:

a second removable mane component having a second base to secure the second removable mane component within the channel and a mane having a plurality of natural or artificial threads with at least one characteristic distinct from the mane of the first removable mane component.

4. The toy of claim 1, where the mane is slidably disposed within the mane hair component to enable lengthening or shortening of a portion of the mane extending out from the mane hair component.

5. The toy of claim 1, wherein the base of the mane hair component includes a triangular cross-section and the channel includes a corresponding triangular cross-section.

6. The toy of claim 5, wherein the base of the mane hair component includes a first opening at one end through which a first portion of the mane exits the base.

7. The toy of claim 6, wherein the base of the mane hair component includes a second opening along a length of the base through which a second portion of the mane exits the base, the first opening being separated from the second opening by a portion of the base.

8. The toy of claim 7, wherein the base has a length of 1 centimeter to 3 centimeters, wherein the base is molded plastic, and wherein the second opening has a length from 1 centimeter to 3 centimeters.

9. A toy comprising:

an integral housing defining a shape of an animal;

a channel defined by a first side portion and a second side portion of the housing and having a length, the first and second side portions being fixed relative to one another, the channel having a first channel end defining a first opening and a second channel end, the first and second channel ends being located at opposite ends of the length, the channel being configured to couple with a first removable mane component;

wherein the first removable mane component includes a base configured to secure the removable mane component within the channel and a mane having a plurality of natural or artificial hairs, the channel having a second opening through which the mane extends;

wherein the base includes a first base end and a second base end, the base having a longitudinal axis extending from the first base end to the second base end;

wherein the removable mane component is coupled to the integral housing by inserting the first base end of the base of the mane component into the first opening of the channel and sliding the base into the channel in a first direction parallel to the length of the channel; and wherein the base is removed from the channel by sliding the base in a second direction parallel to the length of the channel.

10. The toy of claim 9, wherein the first and second side portions converge towards the second opening.

11. The toy of claim 9, wherein the base includes a first base opening through which a first portion of hairs exit the base, and the base includes a second base opening long the length of the base through which a second portion of the hairs exit the base.

12. The toy of claim 9, wherein the first base end is adjacent the second channel end and the entirety of the base is located within the channel when the base is completely inserted into the channel.

13. The toy of claim 9, wherein the channel extends along the top of the neck of the animal and the first channel end is positioned higher than the second channel end.

14. The toy of claim 9, wherein the base includes a triangular cross-section and the channel includes an inner portion having a triangular cross-section.

15. The toy of claim 9, wherein the first and second side portions are unitary with the integral housing.

* * * * *